US006622431B1

(12) United States Patent
Simons

(10) Patent No.: US 6,622,431 B1
(45) Date of Patent: Sep. 23, 2003

(54) ADJUSTABLE INDEPENDENT DRAFT BLOCKS FOR SEALING GARAGE DOORS OR THE LIKE

(76) Inventor: John C. Simons, 601 B Wren Song Rd., Yardley, PA (US) 19067

( * ) Notice: Subject to any disclaimer, the term of this patent is extended or adjusted under 35 U.S.C. 154(b) by 0 days.

(21) Appl. No.: 09/928,064

(22) Filed: Sep. 26, 2001

Related U.S. Application Data

(60) Provisional application No. 60/235,343, filed on Sep. 26, 2000.

(51) Int. Cl.[7] ..... E06B 7/18

(52) U.S. Cl. ..... 49/197; 49/303; 49/476.1; 160/40

(58) Field of Search ..... 49/197, 199, 200, 49/303, 306, 316, 317, 318, 476.1, 484.1, 198; 160/40, 201, 205, 185

(56) References Cited

U.S. PATENT DOCUMENTS

| | | | | | |
|---|---|---|---|---|---|
| 839,213 | A | * | 12/1906 | Schwartz | 49/470 |
| 915,566 | A | * | 3/1909 | Dimick | 160/218 |
| 921,159 | A | * | 5/1909 | Porter | 49/480.1 |
| 1,048,407 | A | * | 12/1912 | Godfrey | 49/480.1 |
| 2,093,020 | A | * | 9/1937 | Norberg | 160/201 |
| 2,870,495 | A | * | 1/1959 | Wetzel | 160/40 |
| 4,020,595 | A | * | 5/1977 | Duncan | 49/306 |
| 4,320,793 | A | * | 3/1982 | Lindbergh | 160/194 |
| 5,371,987 | A | * | 12/1994 | Hirsch et al. | 49/239 |
| 5,467,559 | A | * | 11/1995 | Owens | 160/40 |
| 5,611,382 | A | * | 3/1997 | Sferra | 160/113 |
| 6,442,901 | B1 | * | 9/2002 | Rissone | 49/470 |

FOREIGN PATENT DOCUMENTS

| | | | |
|---|---|---|---|
| DE | 2622152 | * | 11/1977 |

* cited by examiner

*Primary Examiner*—Gregory J Strimbu

(57) ABSTRACT

A bottom weather seal for doors comprised of independent, vertically moving adjacent blocks capable of engaging and sealing an uneven garage floor or sill. Each block has a vertically-running tongue on each side, which engages the vertically running tongues of each adjacent block, thereby providing a guide and seal for and with each adjacent block. Each block is moveably attached to a door by a screw attached to the door, and which passes through a pre-cut slotted opening cut in each block.

8 Claims, 4 Drawing Sheets

ADJUSTABLE INDEPENDENT DRAFT BLOCKS FOR SEALING GARAGE DOORS OR THE LIKE

RELATED APPLICATIONS

This application claims priority from the U.S. Provisional application No. 60/235,343 filed Sep. 26, 2000 and entitled ADJUSTABLE INDEPENDENT DRAFT BLOCKS FOR SEALING GARAGE DOORS OR THE LIKE.

BACKGROUND

1. Field of the Invention

The present invention relates to weather seals and more particularly, to an adjustable weather seal for the bottom of vertically opening doors.

2. Description of Related Art

Currently, conventional garage door seals are made as combination door stops and seals. Typically these seals have a rigid base with a flexible sealing lip, wherein the sealing lip generally protrudes from the base at an angle. For example Stutzman in U.S. Pat. No. 4,525,953 Weather Seal with Wide Range of Flexure discloses a seal having a base section that is secured to the bottom edge of a door and a resilient arm section of sufficient dimension to provide a range of flexure extending away from an end portion of the base section and back and under the door to resiliently engage an end section against the floor surface. The end section extends back from the arm section at an acute angle and, with the door in a closed position, the arm section provides a substantially constant loading of a sealing surface in engagement with the floor surface for the full extent of the garage door.

Cole and Lillie U.S. Pat. No. 4,447,988 for Garage Door Weather Seal disclose a garage door weather seal for use on a garage, the weather seal having a door with a planar outside surface and a door frame including a surface normal to the plane of the garage door when closed. The weather seal disclosed by Cole and Lillie comprises a main body portion which lies in a plane extending at an angle to both the door and door frame surfaces when installed. Lips of the seal are integrally molded to opposite edges of the main body portion to form a weather-tight seal with both the surface of the garage door and the surface of the door frame. An L-shape leg structure connected with the main body portion serves to position the weather seal with respect to the door frame. The leg structure has two legs which deflect slightly to grip two surfaces of the door frame, one the above-mentioned surface and another normal thereto. One of the legs may have apertures for fasteners to hold the seal in place.

Yet another type of garage door seal is a coil type seal. Brookman and Jackson Weather in U.S. Pat. No. 5,029,079 disclose a coil type weather seal for a roll-up type garage door having a gap between the door and a support surface. This weather seal includes a base member secured to the support surface, and a block pivotally connected to the base member for pivotal movement relative to the base member. A sealing lip is connected to the block and has a first position in the plane of the base member, wherein the block has a means for engaging the support surface for pivotally moving the block and moving the sealing lip to a second position at an angle to the base member when installed so that the sealing lip engages the door to effect a seal between the door and the sealing lip.

One problem with the rigid base seals is that they must be sold in fixed cut lengths, rendering the replacement of rigid base seals costly when some portion of the seal becomes damaged or defective, and making them ineffective when they are applied to non-standard-sized doors. In addition, the rigid base seal cannot be compacted, which makes it cumbersome to package and transport.

And another problem with rigid or even flexible base seals comprised of unitized strips or pieces of material is that non-uniform or uneven gaps occur between garage doors and opposite stationary surfaces; in particular at the bottom of overhead garage doors. Overhead garage doors frequently have an uneven gap that is usually narrower at the center and wider at the ends due to the door sagging or resting upon an uneven floor. Even flexible base seals constructed from materials such as rubber or plastic have limitations in the ability of said seals to accommodate moderately rough or uneven floors. Therefore there is a need for an effective weather seal suitable for preventing cold air, snow, water and the like from entering the garage along the bottom of a garage door, even when the garage door rests upon an uneven or non-smooth floor or surface.

OBJECTS AND SUMMARY OF THE INVENTION

Therefore in view of the prior art mechanisms and devices for sealing garage doors and the like, the present invention is disclosed an improvement over the prior art—the invention comprising adjustable, mutually engaging and independently movable blocks for attaching to and sealing a garage door or the like. The sealing device and mechanisms have several advantages that are expressed by objects of its design and structure.

A first object of the present invention is to provide a weather seal for a vertically opening door capable of sealing the bottom of the door, even when the door rests upon a highly irregular or uneven surface.

Another object of the present invention is to provide a weather seal that is adjustable and adaptable to variations in the distance from the door to the sill or floor upon which the door normally rests; when such variations are caused by wear and tear on the door hinging mechanisms.

And another object of the present invention is to provide a weather seal which is modular, meaning that the entire seal does not have to be replaced if a portion thereof becomes damaged or defective, or if additional variations occur in the sill.

And yet another object of the present invention is to provide a weather seal that prevents a wooden door from rotting by resting against an inside sill or floor and trapping water between said door and said sill or floor.

These objects plus other advantages of the present invention will become clear and apparent from the descriptions and drawings included hereafter.

And therefore in accordance with these objects and other objects, a disclosure is made herein of a weather seal comprising a plurality of independent, adjustable blocks, constructed to mutually, and cooperatively engage and jointly seal against intrusion of water and weather when attached to the bottom of a door.

These adjustable, independent blocks are attached to the bottom, inside of a door in a manner that permits individual blocks to move up and down, vertically and therefore to rest upon the garage sill or floor when the door is down and in unlocked position. Each block that is adjacent to a given block can, also, move independently and vertically with respect to that given block, while being constrained from moving horizontally or from moving in a direction perpendicular to the plane of the door. Therefore if the elevation of garage floor or sill is changing in a irregular fashion, the combined independent, vertical moving blocks can still seal the space between the door and the floor or sill.

Each adjustable, independent block is fastened to the bottom, inside of a door using a fastening means, as an example, a common screw, which is not tightened sufficiently to hold each block immovable. When a screw is used as a fastening means, each screw is attached to the bottom of the door, and passes through its respective block within a pre-cut slotted opening within each said block. Each slotted opening is dimensioned to permit the screw to pass through the slotted opening and attach to a door, while permitting the block to slide up and down without the screw binding or constraining vertical movement.

The slot opening has a reset for receiving the screw head, so that the top of the screw head will be below the surface of the block, when the screw is completely screwed into the door.

Preferably each slot with recessed screw is covered with tape to prevent air or moisture from seeping through the slotted opening to the inside. Or if the blocks used are molded from plastic, an insertion cap will also be provided to insert tightly into the slotted opening to prevent water or dirt from collecting in the slotted opening.

When so attached, each adjustable block will ride up and down constrained to vertical movement by the screw engaging the slotted opening and each adjacent block independently moving. By providing independent, vertical movement, it can be seen that each block will conform to the height of the sill or garage floor immediately under the block when the door is down and held in a locked position.

It can also be seen that the door does not come in contact with the sill and therefore cannot trap moisture beneath said door; thereby eliminating a major cause of rot in wooden doors, or rusting and corrosion of metal doors.

DETAILED DESCRIPTION

A Preferred Embodiment

Figure 1:
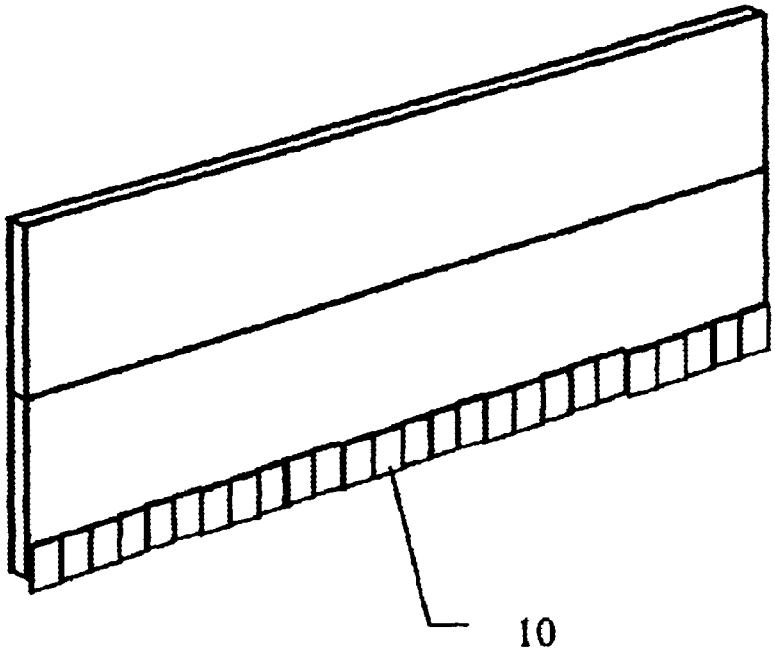
FIG. 1 shows the present invention used with a standard door, wherein the independent, adjustable blocks 10 are shown moveably attached to the bottom of the door.

The present invention is a device for attachment to a vertically opening door, such as a garage door, and provide a weather seal from and by a plurality of blocks FIG. 1 10. Each block moves independently of adjacent blocks, but is constrained to move only in a vertical direction when each block is moveably attached to a door such that the blocks lie in a plane spaced from and parallel to a plane in which the door lies when closed. Each block is held by a fastening means 50, such as a screw, which is inserted through the slotted opening 30 of the block and is fastened to the door, in any manner that secures the block to the door, but does not prevent vertical movement of the block It will be apparent from this disclosure the sealing device can be used on any door that opens vertically, such that the door is lifted or slides upward.

Figure 2:
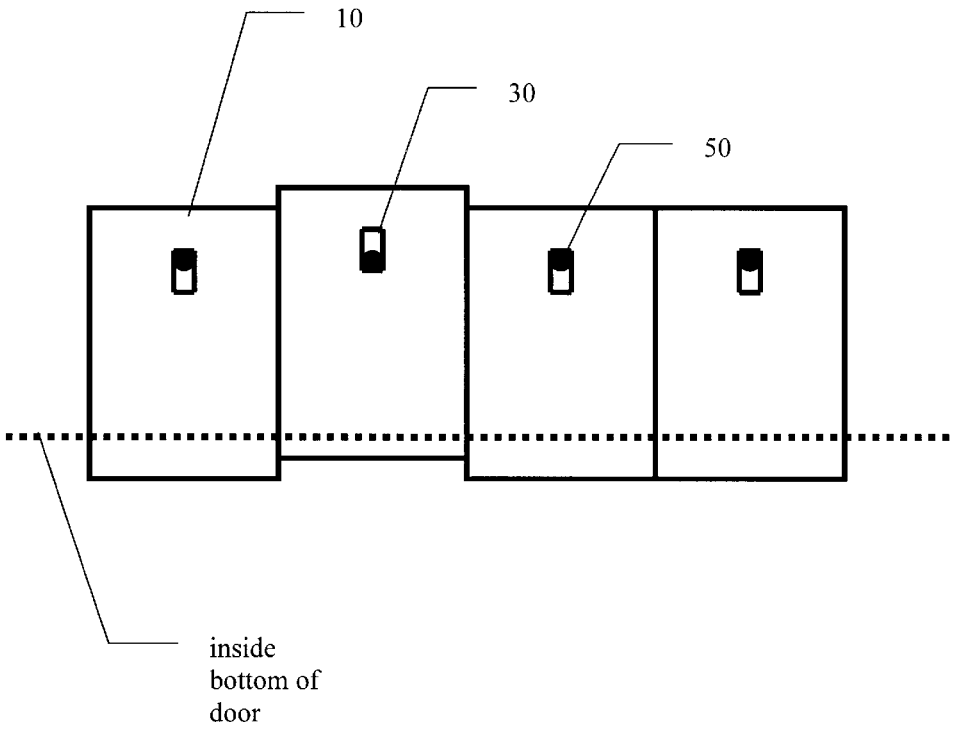
FIG. 2 shows a sequence of the independent, adjustable blocks 10 as connected by screws 50 to the inside bottom of the door, and resting upon the sill or floor of the garage. Each independent, adjustable block has a screw, as one means of attachment; each screw passing through a slotted opening 30 in the block, and into the door.

Each independent block is made with a slotted opening FIG. 2 30, which receives a fastening means. The slotted opening runs vertically with respect to the block, when the block is attached to the door by the fastening means. When attached to the door, the slotted opening is of sufficient size and dimension to permit each block to move vertically, and independently of each adjacent block. During movement, each block slides up and down against adjacent blocks.

Through independent movement of individual blocks, it will be seen that the device is capable of accommodating and sealing between doors and floors or sills even when the floor or sill deviates significantly from a uniform distance from the bottom of the door.

Each block FIG. 2 is of uniform size and constructed so that a plurality of blocks attached and, moving in response to the door making contact with the floor or sill, effect a weather seal to keep water, dirt, debris and insects or animals from entering beneath the door. Typically, vertically opening doors come in a variety of standard sizes, therefore the sealing device can be made and sold in the form of a variety of installation kits, whereby each kit corresponds to a particular door size; each kit having a plurality of blocks of uniform size sufficient to span the width of the door and, therefore, to seal beneath the door and also to effect a seal against the frame within which the door is hung.

Independent, moveable blocks used in the present invention are made from wood that is preferably treated, or coated with plastic, or the blocks can be made from plastic, aluminum or any material that is lightweight, strong and is resistant to rotting or corrosion. When made from a plastic material, the blocks and slot covers may be molded using injection-molding systems.

Individual blocks may be pre-painted in a variety of standard colors or may be primed to be finish painted by an installer or user of the present invention.

Individual blocks have a thickness that is sufficient to be resilient to stresses encountered by a heavy door resting upon the block when not in a locked position, and imparting said stresses to each block through transmission of forces from the attaching means and the associated slotted opening. It will be obvious to those practiced in the arts of building, building material and carpentry that material thickness would depend upon the material used for block construction, and would preferably be at least 0.5 inches for wooden blocks and at least 0.25 inches for metal blocks. Plastic blocks would have a thickness ranging from 0.5 inches up to 1.0 inch, depending upon the material used.

Figure 3:
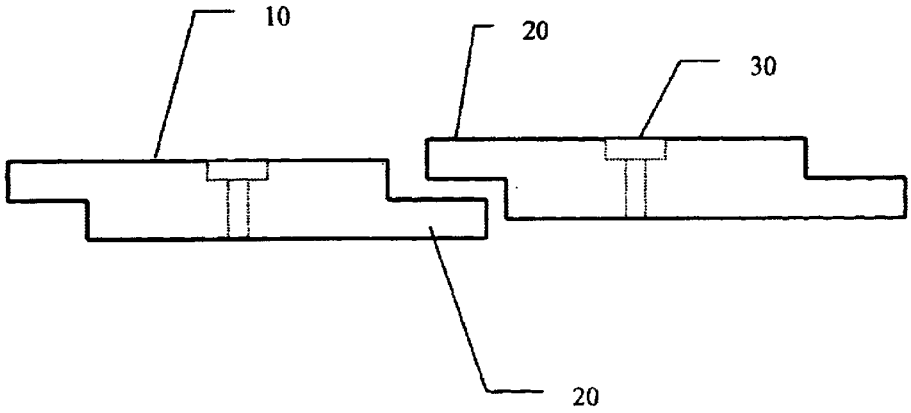
FIG 3. depicts a top view of an independent, adjustable block 10, showing the tongues 20 for engaging adjacent independent, adjustable blocks.

Each block is constructed to seal while sliding vertically against adjacent blocks. In one example, each block has tongues FIG. 3 20 on the vertical edges of each block so that each block may engage each of two adjacent, similar blocks, and wherein so engaged, each of the said adjacent blocks is constrained to move only in a vertical direction. It can be seen that the purpose of the tongues on the blocks also provide a means of sealing the region in which adjacent blocks engage. In this example the thickness of each tongue comprises one-half the thickness of each block, so it should be noted that the thickness of the blocks must also account for the two vertical-running tongues on each side of a block; the purpose of which are to provide a means for adjacent blocks to engage and slide. Therefore the thickness of each block must be sufficient for the tongue to not bend or flex and bind with the tongues of adjacent blocks.

It is envisioned that blocks and attaching means, such as screws, with covering tape or molded caps would be sold at hardware stores, lumberyards, discount building stores, and to OEM manufacturers. Blocks with attaching screws and covering tape would be sold in packages of a fixed number of units sufficient to fit and weather proof all standard size doors.

Blocks may be made in a limited variety of widths so as to accommodate common sized or standard doors, and can even include "odd" sizes in order to accommodate doors that are not standard sized.

In the case where the fastening means is a screw, each block is constructed with a smooth, pre-cut or molded slotted opening and a matching screw that would permit free vertical movement of the block. Screws would be selected from standard, available sizes and would be made from stainless steel, or aluminum or brass.

Figure 4:
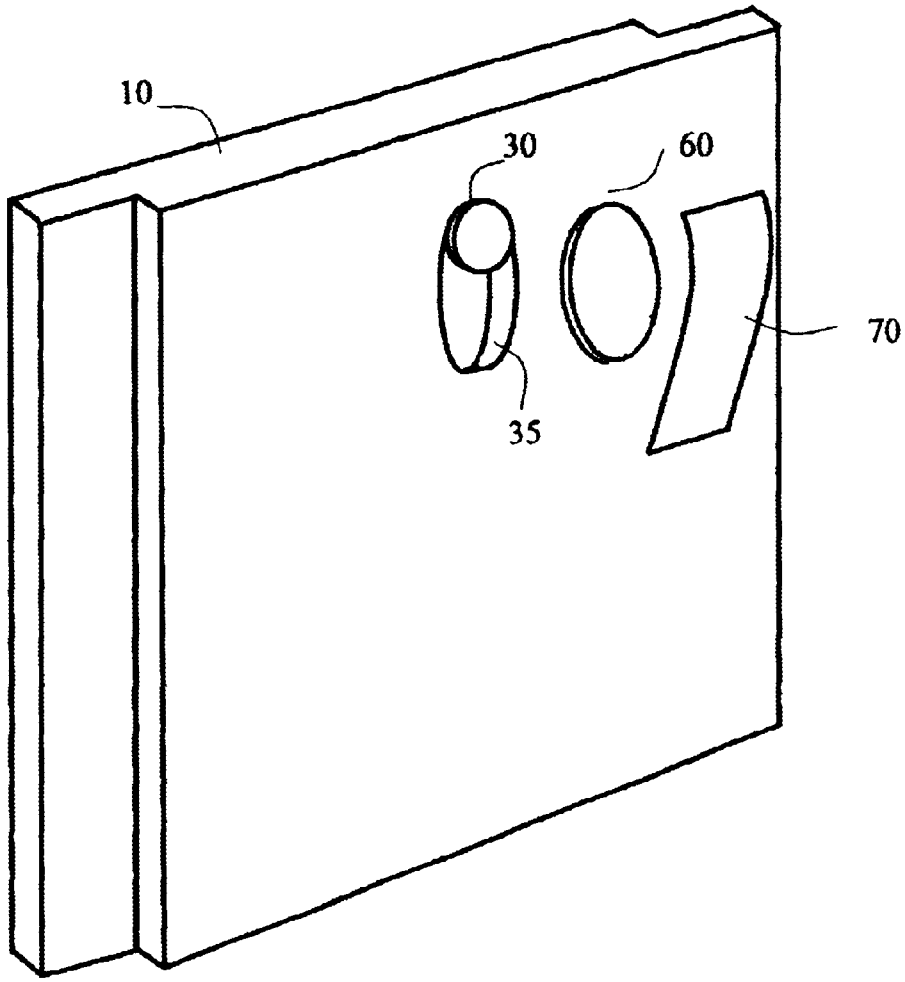
FIG. 4 shows means for sealing the slotted opening, either by a cap 60 received by the slotted opening or by tape 70 covering the slotted opening.

See FIG. 4 the slotted opening is made with a reset 35 so that the head of a screw will be below the surface of the block, and be held by the reset to prevent the screw from passing completely through the slotted opening. When the screw is inserted into a door, tape 70 or a cap 60 is placed over the slotted opening to prevent water or other material from passing into or through the slotted opening.

It can be seen that the present invention, when constructed and used in the manner disclosed herein provides an inexpensive, yet effective means of sealing a door.

It can also be seen that due to the independent vertical movement of the blocks provide an effective solution to sealing a door against a rough and uneven garage floor or sill.

Although the present invention has been described with reference to a preferred embodiment illustrated in the attached drawing figures, it will be appreciated that substitutions or variations can be made in the elements of the present invention without departing from the scope of the invention recited, whereby the true scope and breadth of the invention is defined by the following claims.

What is claimed is:

1. A weather seal for sealing against drafts, the weather seal comprising:

a plurality of edge-abutting, independently moveable solid blocks, each block having a slotted opening and for preventing said drafts from passing therethrough; and, a block fastening means for attaching each block to a garage door, wherein each of the block fastening means is received through the slotted opening of a respective one of the blocks, the block fastening means attached to the door, and wherein a face of each of the edge abutting blocks is held against the door and moves vertically to make a seal between an adjacent one of said blocks and a seal between the door and one of a floor and a sill when the door is closed.

2. The weather seal of claim 1, wherein each block has a lip that forms said seal between said adjacent one of said blocks.

3. The weather seal of claim 2, the weather seal further having a slotted opening sealing means for sealing the slotted openings.

4. The weather seal of claim 3, wherein each of the slotted opening sealing means comprises a cap.

5. The weather seal of claim 4, wherein said blocks are made from wood.

6. The weather seal of claim 4, wherein said blocks are made from plastic.

7. The weather seal of claim 4, wherein said blocks are made from metal.

8. A weather seal comprising a plurality of abutting solid rectangular blocks for preventing drafts from passing therethrough, each block having a block fastening means for attaching the block to a garage door, each of the blocks constrained to move independently of each other by the block fastening means, the block fastening means constraining the blocks to move vertically wherein the blocks lie in a plane which is parallel to and spaced from a plane in which the garage door lies when in a closed position, the block fastening means further constraining each of the blocks to abut at least one adjacent said block, wherein each block moves vertically to occupy space between the door and a sill when the door is in the closed position, and thereby to make a seal therebetween.

* * * * *